United States Patent [19]

Guy

[11] 4,244,558

[45] Jan. 13, 1981

[54] FRAME-POSITIONING DEVICE FOR MOUNTING CANVAS AND LIKE MATERIAL

[76] Inventor: Richard Guy, 27752 Torija, Mission Viejo, Calif. 92691

[21] Appl. No.: 30,010

[22] Filed: Apr. 16, 1979

[51] Int. Cl.[3] ..... B66F 19/00

[52] U.S. Cl. ..... 269/254 R; 254/199

[58] Field of Search ..... 254/51, 77, 79, 83; 269/254 R, 37; 38/102 R, 102.91, 102.4; 160/378

[56] References Cited

U.S. PATENT DOCUMENTS 4,180,246 12/1979 Guy ..... 254/77

*Primary Examiner*—Robert C. Watson

*Attorney, Agent, or Firm*—Francis X. LoJacono

[57] ABSTRACT

A frame-positioning device for mounting and stretching canvas and like materials that must be stretch-mounted to a supporting stretcher-frame structure, generally comprising a four-sided wooden frame member, whereby the canvas is stapled thereto. The frame-positioning means includes a pair of stretcher bar holders which are arranged to be slidably received on the structural-beam member of a canvas-stretching-and-mounting apparatus, so as to be adjustable in vertical and horizontal planes along the beam to accommodate various sizes of frames.

6 Claims, 4 Drawing Figures

FRAME-POSITIONING DEVICE FOR MOUNTING CANVAS AND LIKE MATERIAL

BACKGROUND OF THE INVENTION

1. Field of the Invention

This invention relates generally to a canvas-mounting device, and more particularly to a pair of stretcher-bar holders associated with the device whereby the stretcher frame is readily positioned thereon.

2. Description of the Prior Art

As is well known in the art, various problems and difficulties are encountered in providing suitable means for simultaneously mounting and stretching canvas to a supporting stretcher-frame structure, wherein the stretcher-frame structure comprises a generally rectangular framework having four wooden side members.

For years, the mounting and stretching of canvas—both in unpainted and painted form—have been generally accomplished by hand. Thus, many problems existed because the canvas was not stretched sufficiently or evenly along all four sides, creating waves or ripples in the stretched canvas. An artist was usually reluctant to use the framed canvas under such conditions.

Additionally, if a painted canvas was loose or had not been mounted and stretched properly, it could possibly not be sold for its true value.

Various types of mounting and stretching devices have been conceived and utilized, and some are still being used at the present time. However, these devices have features that restrict their use; and they are usually expensive, often complicated, and time-consuming in operation.

Canvas-stretching devices must be provided with means to grab and secure the canvas while it is being stretched and fastened to a frame structure. It has been found in the past that a regulated force must be provided to secure the canvas along its edge without ripping or damaging the canvas. Therefore, machines of this type have been produced with complicated pressure and hydraulic systems, which not only consume much space but are also very costly. Further, the designs of these devices are such that they are generally limited to a very small range of canvas frame sizes.

Accordingly, there is a need for a device of simple construction that is capable of accepting all sizes of frame structures, without damage to the canvas as it is stretched and fixed to the frame member.

SUMMARY OF THE INVENTION

The present invention comprises a pair of stretcher bar holders that are associated with an apparatus for stretching and mounting canvas and other like materials to a stretcher-frame structure, as originally disclosed in patent application Ser. No. 956,076, which has issued under U.S. Pat. No. 4,180,242 to Richard Guy.

The apparatus also comprises an elongated, tubular, structural-beam member that is horizontally disposed and affixed at each end to vertical supports. A spring-loaded, clamping-bar member is hingedly connected to the structural beam so as to be positioned along the top wall of the beam, thus defining a jaw-like member having a longitudinal-securing keeper bar mounted to the underside of the clamping bar. This allows one free edge of the canvas to be releasably secured while tension is being placed on the canvas as it is stretched over the canvas-stretcher frame.

It should be noted that this apparatus is also adapted to stretch needlepoint materials as well as silk-screen materials.

Mounted to one end of the main beam is an operating handle that is spring-loaded, whereby the spring-loaded clamping bar can be placed in an open position to receive the free edge of the canvas material. As the clamping bar is opened, it is engaged by an automatic, releasable, locking trigger that prevents the clamping bar from closing until the canvas is ready to be stretched. That is, the locking trigger is pivotally mounted to the main beam and adapted to be longitudinally adjusted thereon. By pressing downwardly on the trigger, the clamping bar along with the keeper bar engage the free end of the canvas and allow the frame to be rotated downwardly over a pair of stretcher-bar holders. The stretcher-bar holder is also slidable along the full length of the main-beam member, so as to be adjustable to any particular size of canvas-stretcher frame.

Accordingly, each free edge of the canvas is positioned by the jaw-like operation and then stretched, at which time the secured edge is stapled along the length of the mounting-frame member.

OBJECTS AND ADVANTAGES OF THE INVENTION

The present invention has for an important object a provision wherein stretcher-bar holders can be adjusted to allow various sizes of canvases to be mounted to corresponding sizes of frame members, without affecting the arrangement of the stretching and mounting apparatus.

It is another object of the invention to provide a stretcher-bar holder having a support-head member formed with a substantially "C"-shaped configuration wherein the curved head portion protrudes outwardly and inwardly, defining a substantially flat shoulder member on which the frame structure is supported.

Still another object of the invention is to provide a device of this character that can be adjusted longitudinally as well as vertically, whereby the longitudinal adjustment corresponds to the width of the frame structure, and the vertical adjustment allows the frame structure to be positioned even with the top of the beam of the apparatus, thereby assuring a very tightly stretched condition of the canvas over the frame structure.

It is another object of the invention to provide a device of this character that is easily adjusted, serviced and maintained.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
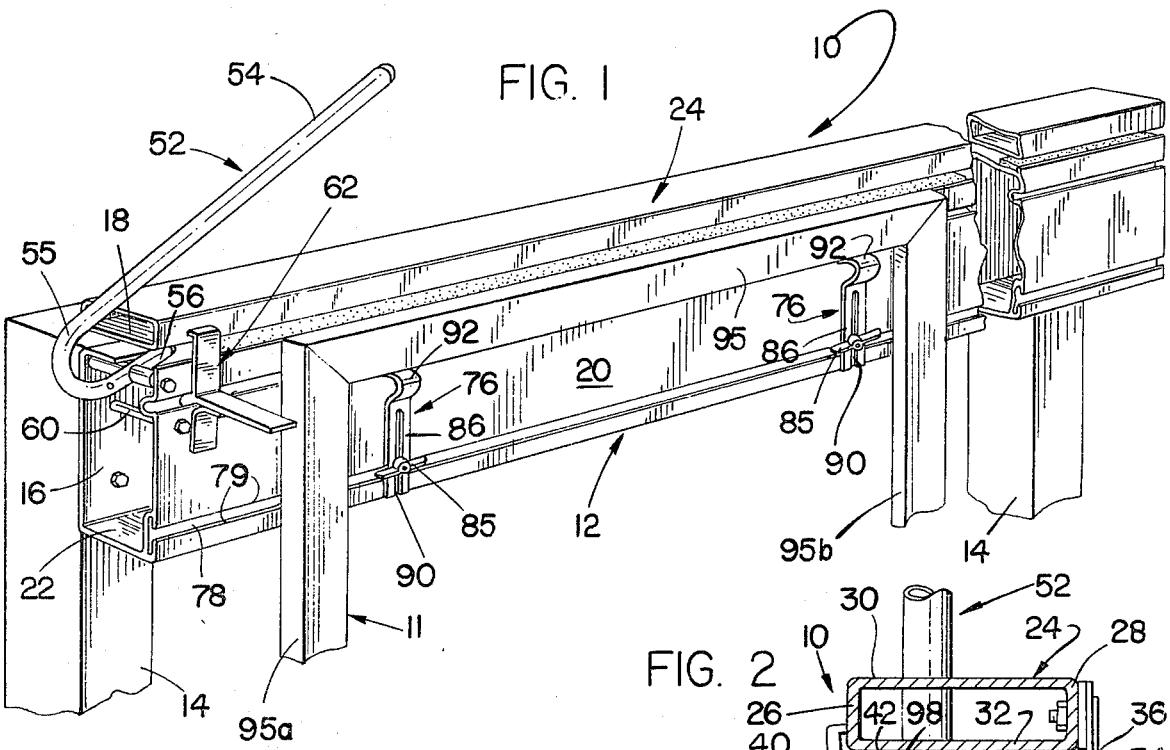
FIG. 1 is a pictorial view of the present invention mounted to a canvas-stretching apparatus wherein a portion of a stretcher-frame member is shown supported by the stretcher-bar holders.

Referring more particularly to FIG. 1, there is shown a canvas-stretching-and-mounting apparatus, generally indicated at 10, having supported thereon a stretcher-frame member 11, the apparatus comprising a main, structural, elongated beam member 12. Beam 12 is horizontally mounted at each free end to vertical support members 14. It should be noted that support members 14 represent various types of stands or support structures that would allow apparatus 10 to be mounted horizontally, as herein shown and described.

Beam 12 is further formed as a substantially rectangular tubular member by means of extrusion molding wherein the beam is defined by a rear wall 16 attached directly to the support members 14, a top wall 18, a front wall 20, and a bottom wall 22. Hingedly mounted to the rear wall 16 and longitudinally disposed over the top wall 18 is a clamping bar 24, which is also a hollow tubular member defined by a front wall 26, rear wall 28, and top and bottom walls 30 and 32, respectively.

Thus a hinge means 34 is provided, and is mounted to the rear walls 16 and 28 of beam 16 and clamping bar 24, respectively, whereby clamping bar 24 is spaced upwardly from beam 12.

Included within each inge 34 is a biasing means 36, illustrated as a coil spring located about the hinge pin 38. (See FIGS. 2 and 3.) Spring 36 creates a downward-biasing force on clamping bar 24, thereby providing the necessary engaging force between the clamping bar and the top wall 18 of beam 12, whereby a free edge of a canvas or like material can be readily secured during the stretching and mounting steps. A detailed description of this procedure will hereinafter be described.

Figure 2:
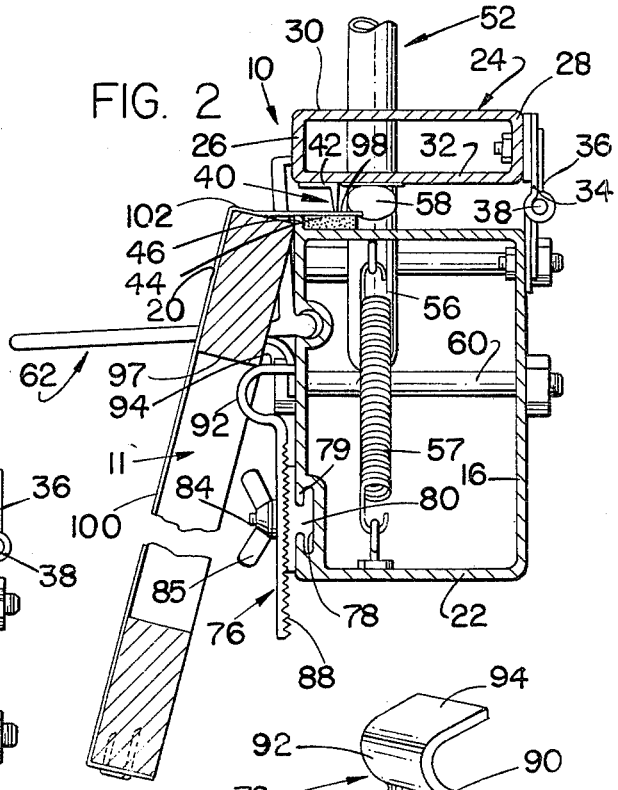
FIG. 2 is a cross-sectional view of the apparatus and frame structure with the frame structure being positioned to stretch the canvas across the frame.
Figure 3:
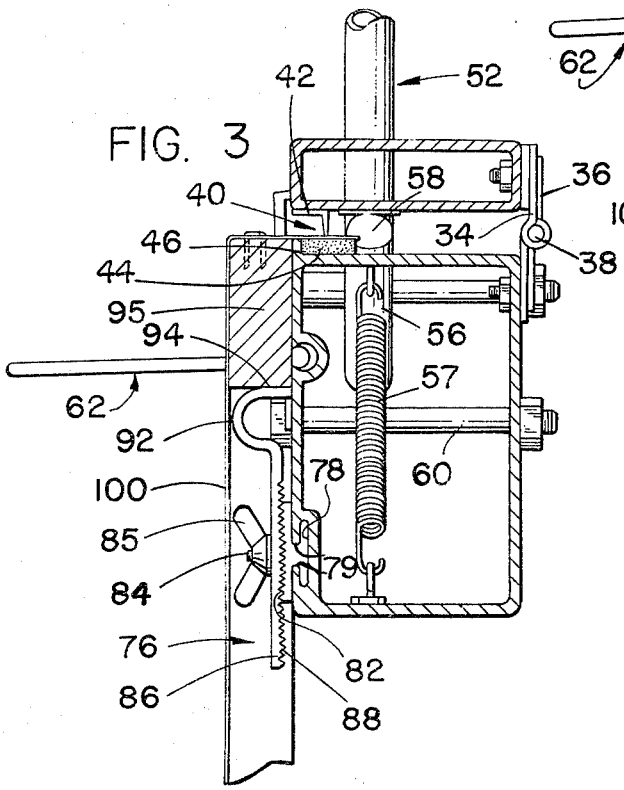
FIG. 3 is a similar cross-sectional view of the canvas shown fully stretched and stapled to the frame structure as it is supported by the stretcher-bar holders.
Figure 4:
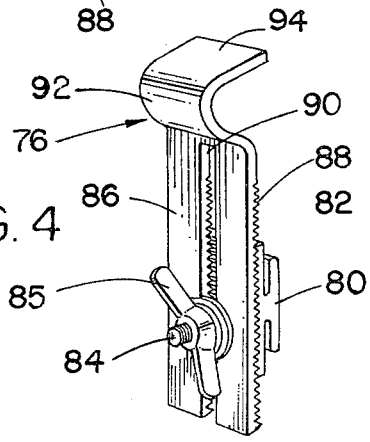
FIG. 4 is a perspective view of one of the stretcher bar holders.

To further provide a more positive securing of the edge of a canvas, there is included a keeper means, generally indicated at 40, and shown in FIGS. 2 and 3. Keeper means 40 comprises mainly an elongated securing keeper bar 42 which is mounted along the full length of the bottom leading edge of clamping bar 24; and it includes a band or strip 44 of pliable material attached to the adjacent leading edge of beam 12, wherein the leading edge thereof is defined by a vertical flange 46. Thus, keeper bar 42 directly engages strip 44—providing a jaw-like arrangement.

Accordingly, during the series of steps in the operation of the apparatus, the jaw-like arrangement of clamping bar 24 must be continuously opened and closed. Thus, to provide this action, a lever-actuating means, indicated generally at 52, is mounted to the apparatus, whereby clamping bar 24 can be opened along the leading edge so as to allow the free edge of the material to be inserted between keeper bar 42 and strip 44, and then closed to secure the material therein. As herein illustrated, lever-actuating means 52 comprises a handle 54 having a gripping, extended free end and a pivoted curved end 55, including an extended neck porton 56 which is tipped with a nylon head member 58.

Handle 54 is shown in a closed mode whereby biasing means or spring 57, which is attached between handle 54 and beam 12, secures handle 54 in a downwardly released position. Thus, to open clamping bar 24, handle 54 is pulled outwardly, causing head 58 to forceably engage bottom wall 32 of bar 24 and thereby lifting clamping bar 24. As the handle is rotated, neck 56 abuts a stop means defined by pin 60. Accordingly, handle 54 can be manually returned to a closed mode, allowing clamping bar 24 to again close.

However, for a more complete and safer operation of the clamping action, there is further provided a releasable locking means, indicated generally at 62.

Due to the fact that it is very important to position frame 11 on a level and equal plane relative to the upper leading edge 46 of beam 12 (See FIGS. 1 and 3.), there is included a frame-positioning means represented by a pair of frame holders 76. The frame holders are designed to be adjusted vertically and horizontally along beam 12. Beam 12 is provided with a longitudinal channel 78 having inwardly formed flanges 79 disposed along the lower face of front wall 20, wherein there is slidably received a mounting-lug member 80 formed to fit the configuration of channel 78. Lug 80 includes a keyed face 82 defined by a plurality of teeth members and a threaded pin 84, to which a wing nut 85 is mounted. Coupled to lug 80 is the frame-support holder 76, the holder being adjustable vertically by means of a keyed inner face, represented by matching teeth 88, so as to engage with teeth 82 of lug 80. The frame-support holder further comprises an extended flat body 86 having an elongated slot 90 disposed therein to adjustably receive pin 84. Slot 90 allows holder 76 to be raised or lowered to the proper height for each particular size frame structure. The upper end of holder 76 includes a support head 92 formed having a substantially "C"-shaped configuration, wherein the curved head portion protrudes outwardly from beam 12 and then projects inwardly, providing a substantially flat shoulder member 94 on which one of the frame bars 95 is supported, such as seen in FIGS. 1,6 and 7.

OPERATION

The following is one example of how the canvas is stretched and mounted to the canvas-frame structure 11.

After the main structure of apparatus 10 is fixedly mounted to a support structure, as indicated by 14, the frame holders 76 are positioned and set to accept a particular canvas frame 11. Thus, each holder 76 is located and positioned longitudinally within channel 78, whereby each holder is adjacent the respective upright frame bars 94*a* and 94*b*, as seen in FIG. 1. Once the longitudinal positon of holders 76 is set, the vertical position is set by raising or lowering the holder up or down until the stapled edge of frame bar 95 is even with the top of beam 12 (as seen in FIGS. 1 and 3) and tightening nuts 85.

Handle 54 is pulled to open the clamping bar, at which time the releasable locking trigger 62 catches under clamping bar 24, holding it open. Then, a free edge 98 of a canvas 100 is positioned between keeper bar 42 and strip pad 44. The canvas is pressed against the corners of frame bar 95 to determine the alignment of the canvas to the frame. When the canvas is in the proper location, trigger 62 is pressed, allowing clamping bar 24 to close. The operator slides an index finger along the length of the leading edge of bar 95, thereby creasing the canvas at point /102 (FIG. 2). The canvas is now stapled to bar 95.

Handle 54 is again pulled to open clamping bar 24, thus releasing the edge of canvas 100–clamping bar 24 again being latched by trigger 62.

The canvas together with the stretcher frame 11 is turned around to the opposite side (the unstapled side) and the free edge of the canvas is again positioned under keeper 42. The canvas frame 11 is held against beam 12 above holders 76 at approximately 45 degrees, as indicated in FIG. 2. It should be noted that the higher the frame 11 is held the tighter the canvas is stretched. A 45-degree angle, however, is the preferred angle in most mounting operations.

The trigger is again released and the frame is rotated downwardly, causing the frame bar to engage along edge 97 with the arcuate cam surface of head 92 of holder 76 until bar 95 is flush against beam 12. The canvas is now stretched in one direction and is stapled in place. Canvas 100 is again released, and then the corners are folded on the unstapled side, the unstapled side being again positioned in the machine, as described before, at an approximate angle of 45 degrees and clamped therein. The canvas is stretched against the holders 76 and stapled to the frame bar 95. The remaining free edge of the canvas is stretched and stapled as described, at which time the canvas should be secured to all sides of the canvas-frame structure 11 in a very smooth and tight manner.

The unique arrangement of the elements of the present device allows the use of virtually any stapling device presently available. Thus, manual, electrical or air-gun types are compatible with the present invention.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form or uses mentioned, except as defined in the accompanying claims.

I claim:

1. A frame-positioning device for mounting and stretching canvas and like materials that are stretch-mounted to a supporting stretcher frame, in combination with a canvas-stretching-and-mounting apparatus, wherein the frame-positioning device comprises:

a pair of oppositely disposed stretcher-bar holders slidably mounted to said canvas-stretching-and-mounting apparatus and adjustably spaced apart from each other to support said stretcher frame thereon;

means for slidably mounting said stretcher-bar holders along the longitudinal plane of said apparatus to support said frame relative to said apparatus; and means for adjusting said stretcher-bar holders in a vertical plane to position the side frame vertically with respect to said apparatus, whereby the canvas mounted on said frame is stretched tightly across said frame.

2. A frame-positioning device as recited in claim 1, wherein each of said stretcher-bar holders includes:

a substantially flat elongated body member;

an elongated slot disposed longitudinally within said body member; and a cam-surface head member adapted to engage said stretcher frame when said canvas is stretched across said frame.

3. A frame-positioning device as recited in claim 2, wherein said cam-surface head is formed having a substantially "C"-shaped configuration, defining a cam surface and a flat extended portion to support said frame thereon.

4. A frame-positioning device as recited in claim 1, wherein said slidable mounting means comprises a lug member slidably mounted to the front wall of said apparatus and adapted to couple with said stretcher-bar holder.

5. A frame-positioning device as recited in claim 4, wherein said slidable mounting means further includes a longitudinal channel formed in said front wall of said apparatus to slidably receive said lug member therein, whereby said stretcher bar holders are adjustable horizontally thereon.

6. A frame-positioning device as recited in claim 2, wherein said vertical-adjusting means comprises:

a keyed surface formed on one side of said flat elongated body member;

a matching keyed surface formed on said lug member to engage said keyed surface of said body member;

a threaded pin projecting from said lug member and adapted to pass through said slot; and a nut member received on said threaded pin to couple said stretcher-bar holder to said lug in a vertical position.

* * * * *